US006073377A

United States Patent [19]

Mehta

[11] Patent Number: 6,073,377

[45] Date of Patent: Jun. 13, 2000

[54] OVER-WRAP LABEL

[75] Inventor: Rajendra Mehta, Dayton, Ohio

[73] Assignee: The Standard Register Company, Dayton, Ohio

[21] Appl. No.: 08/821,910

[22] Filed: Mar. 21, 1997

[51] Int. Cl.[7] ..... G09F 3/10

[52] U.S. Cl. ..... 40/638; 40/630

[58] Field of Search ..... 40/306, 310, 316, 40/317, 630, 638

[56] References Cited

U.S. PATENT DOCUMENTS

| | | |
|---|---|---|
| 3,028,070 | 4/1962 | Schnur et al. . |
| 4,128,954 | 12/1978 | White . |
| 4,312,523 | 1/1982 | Haines . |
| 4,324,058 | 4/1982 | Sherwick et al. . |
| 4,727,667 | 3/1988 | Ingle . |
| 5,016,918 | 5/1991 | Tidwell . |
| 5,207,458 | 5/1993 | Treichel et al. . |
| 5,207,746 | 5/1993 | Jones . |
| 5,262,214 | 11/1993 | Instance . |
| 5,342,093 | 8/1994 | Weernink . |
| 5,389,415 | 2/1995 | Kaufmann . |
| 5,588,239 | 12/1996 | Anderson . |

FOREIGN PATENT DOCUMENTS

| | | | |
|---|---|---|---|
| 610005 | 8/1994 | European Pat. Off. . | |
| 5323877 | 12/1993 | Japan | 40/310 |
| 659854 | 4/1949 | United Kingdom . | |

*Primary Examiner*—Cassandra H. Davis
*Attorney, Agent, or Firm*—Killworth, Gottman, Hagan & Schaeff, LLP

[57] ABSTRACT

An over-wrap label for a container includes a label substrate having a first end and a second end, a first major surface and a second major surface. The first major surface includes a first area of adhesive material adapted to secure the first end of the label substrate to the container, a second area of adhesive material adjacent to the second end of the label substrate, and at least one portion of the first major surface remains free of adhesive. The second major surface includes an area of release material, the label being of a size such that the second end of the label substrate extends around the container and overlaps the first end. The second end is releasably securable to the second major surface of the label substrate by contacting the second area of adhesive material with the area of release material.

17 Claims, 4 Drawing Sheets

OVER-WRAP LABEL

BACKGROUND OF THE INVENTION

Labels used on containers of dangerous, medicinal and/or sensitive materials are usually required to carry information concerning handling precautions, use restrictions, directions for use and storage or other pertinent information. Often the quantity of information exceeds the space on the label available for printing, especially if the container is small and cannot accommodate a large label.

Various means have been proposed to increase the available printing area, such as providing a section of the label which has been accordion folded under an adhesive coated portion of the label. The accordion folded section is then accessed by tearing a perforation which secures the folded area to the container and unfolding that section. However, once the label has been accessed, it is not possible to reattach the label to the container.

Another solution has been to provide the label with a length which extends around the container more than one time.

For example, U.S. Pat. No. 4,324,058 to Sherwick et al. discloses a label having a length longer than the circumference of the container. The label includes a first adhesive layer which is used to secure the label to the container and a releasable adhesive portion which contacts the surface of the label to releasably attach the overlapping portion of the label to the portion of the label already attached to the container. To facilitate removal of the overlapping portion from the rest of the label, the label includes a tab and a releasable contact area.

Another solution was offered by Ingle in U.S. Pat. No. 4,727,667. In Ingle, the label includes an overlapping portion which extends around the container. The overlapping portion is releasably attached to a portion of the label with a pressure sensitive adhesive which has been partially overcoated with a nonadhesive compound to limit its stickiness. This overcoated portion then allows the overlapping portion to be removed from and replaced on the container because the total area of adhesive has been reduced by the overcoating.

However, these types of labels are ineffective because they require the use of more than one adhesive or the use of an additional substance, such as an overcoating, to reduce the stickiness of the adhesive layer. Because these types of labels have an underlying portion on which information is printed and to which the overlapping portion of the label is stuck, when the overlapping portion is removed, the printing on the underlying portions may be partially or totally transferred from the surface of the label to the back side of the overlapping portion making it difficult, if not impossible, to read the information. Further, by applying an adhesive to the entire back surface of the label, it becomes difficult to print indicia on the back side of the label and/or to read any indicia printed on the back side of the label once the label is secured to the container.

For these reasons, a need has developed in the art for a label which can carry large amounts of printed information and on which the message on the underlying portion of the label is not adversely affected when the overlapping portion is removed.

SUMMARY OF THE INVENTION

The present invention solves those needs by providing a label which can be wrapped around a container one or more times and which can carry a large amount of information. An overlapping portion of the label of this invention can be repeatedly removed from and restuck to an underlying portion of the label without damaging any information printed on the underlying portion of the label.

A desired embodiment of the present invention comprises a label substrate having a first end, a second end, a first major surface and a second major surface. The first major surface includes a first area of adhesive adapted to secure the first end of the label substrate to the container, a second area of adhesive adjacent to the second end of the label substrate, with at least one portion of the first surface remaining free of adhesive. The second major surface includes an area of release material. The label has a size such that the second end of the label substrate extends around the container and overlaps the first end. The adhesive adjacent to the second end is releasably securable to the second surface of the label substrate by contacting the area of release material.

Desirably, the label will further include on the second major surface at least one message portion. More desirably, the label will include, on the second major surface, a first message portion and a second message portion, between which the area of release material is positioned.

In another embodiment of the invention, the label includes a security portion extending from an edge of the label substrate bearing the first adhesive area. The security portion bears an adhesive such that the security portion can be attached to a closure device for the container so that the container cannot be opened without tearing the security portion. Desirably, the security portion includes a line of weakness between the first adhesive area and the security portion so that the security portion will separate from the label substrate when the container is opened.

Accordingly, it is a feature of the present invention to provide an over-wrap label having an overlapping portion which can be repeatedly removed from and replaced onto the label substrate without damaging the underlying printing. It is also a feature of the present invention to provide an over-wrap label which can carry a large amount of information. These, and other objects and advantages of the present invention, will become apparent from the following drawings, detailed description and appended claims.

DETAILED DESCRIPTION OF THE INVENTION

Figure 1:
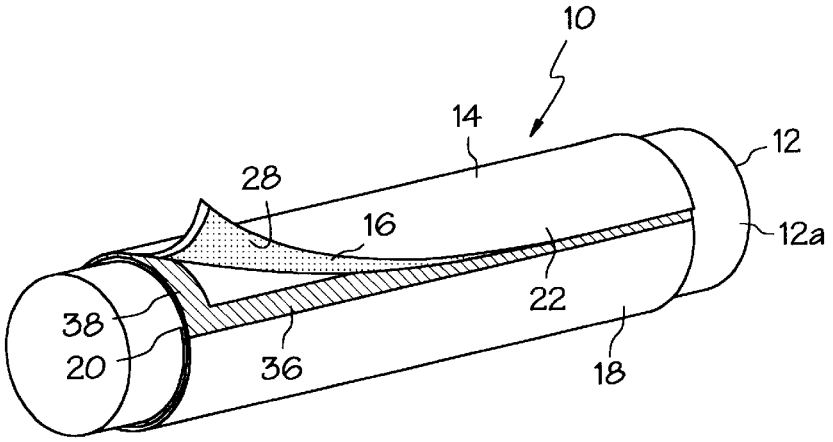
FIG. 1 presents a perspective view of a container to which the label of this invention has been affixed.

Referring first to FIG. 1, a label 10 of this invention is positioned on an outer surface 12*a* of a container 12. Label 10 comprises a substrate 14 which includes a first, back surface 16, shown in detail in FIG. 2, and a second, front surface 18, shown in detail in FIG. 3. For purposes of this detailed description, "back" and "back surface" refer to that surface of the label 10 which faces the outer surface 12*a* of container 12, and "front" and "front surface" refer to that surface of the label 10 which is visible when label 10 is affixed to the container 12. Substrate 14 has a first end 20, which is attached to container 12, and a second end 22, which is releasably secured to the front surface 18 of substrate 14. Second end 22 can be repeatedly removed from and reattached to the front surface 18 of substrate 14 without limiting the effectiveness of label 10.

Figure 2:
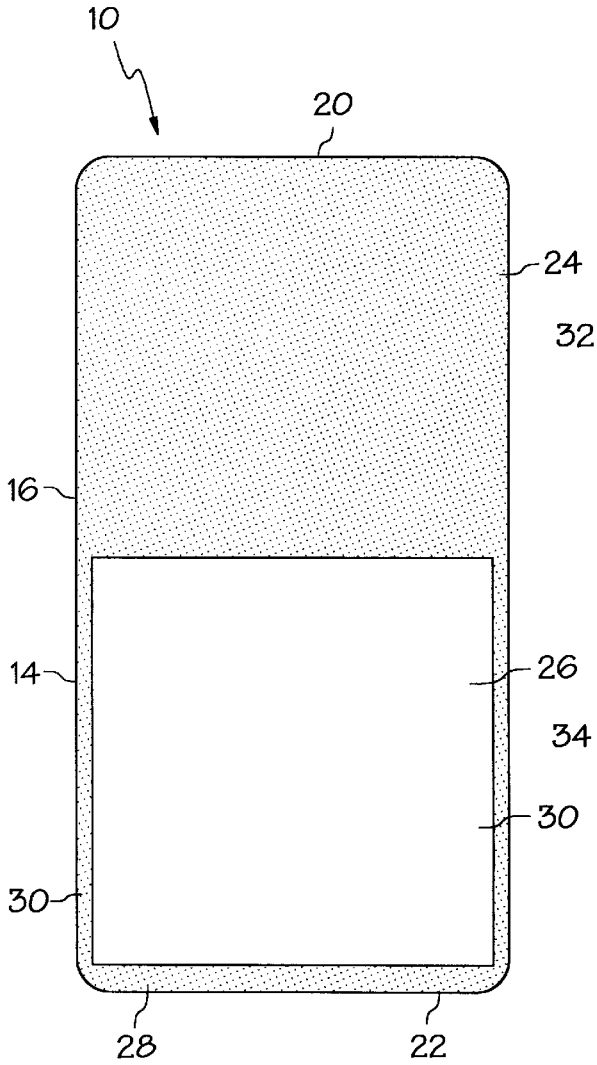
FIG. 2 presents a plan view of the back surface of the label of this invention.

As shown in FIG. 2, back surface 16 includes a first area 24 of adhesive material, a portion 26 free of adhesive material and a second area 28 of adhesive material. First area 24 is positioned adjacent to portion 26. Desirably, first portion 26 is adapted to receive indicia, i.e., indicia can be printed on portion 26. Second area 28 is located in portion 26. The positioning of adhesive area 28 on portion 26 depends upon the number of times label 10 is wrapped around container 12. Desirably, second area 28 is positioned on second end 22 of substrate 14. Additionally, it is desirable that second area 28 bears a pressure sensitive adhesive.

Optionally, back surface 16 may also include one or more adhesive strips 30 of adhesive material and which run longitudinally along substrate 14. Typically, adhesive strips 30 will be positioned along the edges of substrate 14. Desirably, adhesive strips 30 will extend from first area 24 to second area 28 across portion 26.

Figure 3:
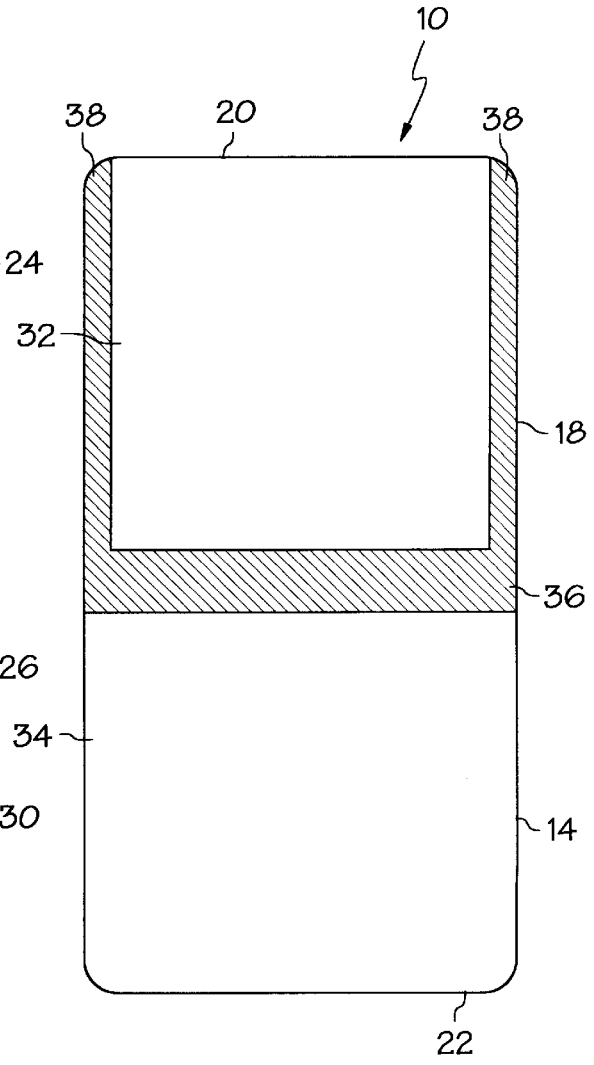
FIG. 3 presents a plan view of the front surface of the label of this invention.

As shown in FIG. 3, front surface 18 of substrate 14 includes a first message portion 32 and a second message portion 34. First message portion 32 is located on substrate 14 adjacent to second message portion 34. First message portion 32 and second message portion 34 are adapted to receive indicia, i.e., indicia can be printed on portions 32 and 34. An area 36 of release material is also positioned on front surface 18 of substrate 14. Area 36 bears a release material. The exact positioning of area 36 on front surface 18 depends on the length of substrate 14 which extends around the circumference or perimeter of container 12 and the positioning of the second area 28 on back surface 16. Desirably, area 36 will be positioned between first message portion 32 and second message portion 34. Although area 36 is shown as being positioned between first message portion 32 and second message portion 34, area 36 can be positioned on either end 20 or end 22 resulting in only one, large message portion being present on front surface 18. In other words, front surface 18 has at least one message portion, such as message portion 32 or message portion 34, and, desirably, two message portions, as is shown in FIG. 3.

Optionally, front surface 18 may also include one or more release strips 38. Release strips 38 will also bear a release material. Typically, release strips 38 will be positioned along the edges of front surface 18. Desirably, release strips 38 extend from area 36 to the first end 20 of substrate 14.

The label 10 is positioned on container 12 in the a following manner. First area 24 is affixed to outer surface 12*a* of container 12 to attach first end 20 of substrate 14 to container 12. First area 24 desirably extends around container 12 at least half way and, more desirably, extends around container 12 a distance equal to or slightly less than the circumference, or perimeter, of container 12.

The remainder of label 10, the portion 26 which is free of adhesive and the second area 28, is wrapped around the outer surface 12*a* of container 12. To secure second end 22 to front 18 of substrate 14, the second area 28 is attached to area 36 which bears a release material. Because area 36 bears a release material, second end 22 of label 10 is releasably secured to front 18 of substrate 14.

If label 10 further includes adhesive strips 30 and release strips 38, the remainder of label 10, which includes portion 26 and adhesive area 28, will be further secured to the front 18 of substrate 14 by the engagement of adhesive strips 30 with release strips 38. With this embodiment, to secure second end 22 to the front 18 of substrate 14, the second area 28 is attached to area 36 of release material and adhesive strips 30 are attached to release strips 38. Thus, the combination of adhesive strips 30 with second area 28 provides a greater surface area for attachment, thereby increasing the strength with which second end 22 is secured to front 18 of substrate 24. Further, by providing label 10 with adhesive strips 30 and release strips 38, movement of end 22 in relation to front surface 18, especially in a direction parallel to area 36 of release material, is reduced.

Figure 5:
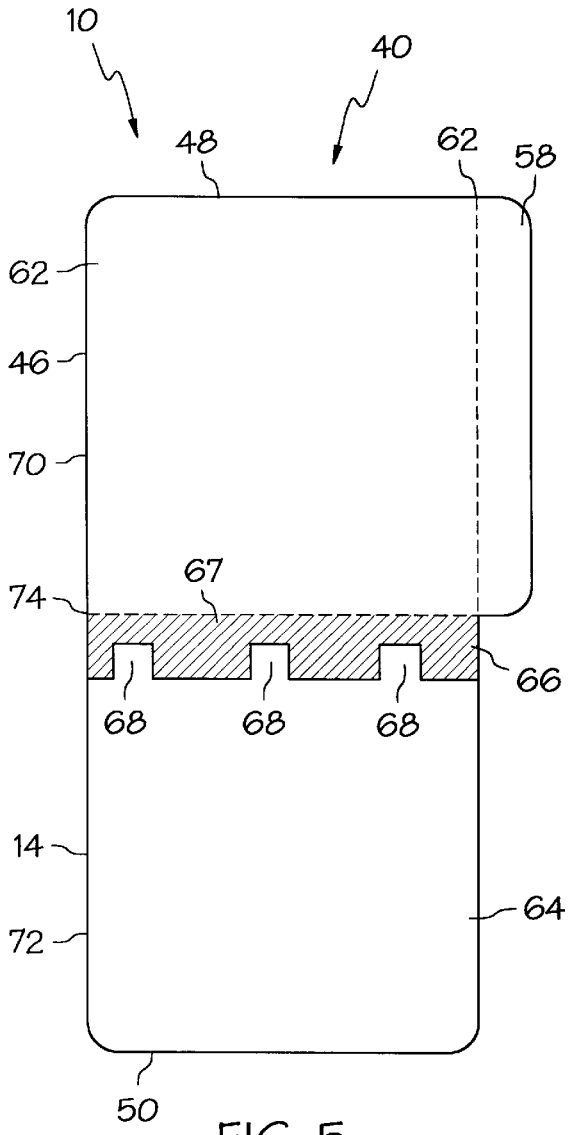
FIG. 5 presents a plan view of the front surface of another embodiment of this invention.
Figure 4:
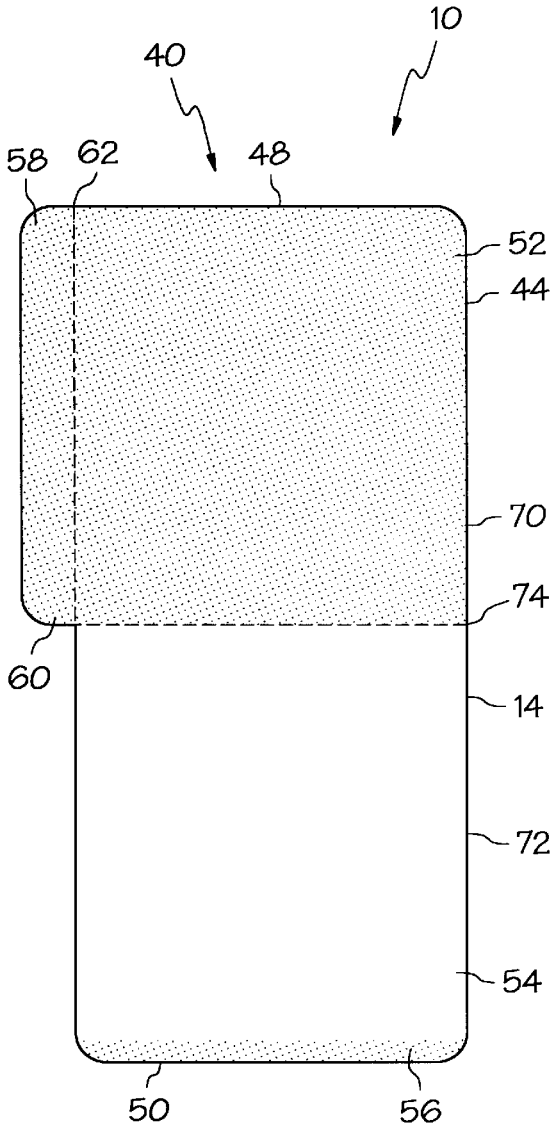
FIG. 4 presents a plan view of the back surface of another embodiment of the label of this invention.

Another embodiment 40 of label 10 is shown in FIGS. 4 and 5. The embodiment 40 of label 10 also comprises a substrate 14 which includes a first, back surface 44, shown in detail in FIG. 4, and a second, front surface 46, shown in detail in FIG. 5. Substrate 14 has a first end 48, which is designed to be attached to container 12, and a second end 50, which is releasably secured to the front surface 46 of substrate 14. Second end 50 can be repeatedly removed from and reattached to the front surface 46 of substrate 14 without limiting the effectiveness of label 10. Embodiment 40 also includes a first section 70 and a second section 72.

As shown in FIG. 4, back surface 44 includes a first area 52 of adhesive material, a portion 54 free of adhesive and a second area 56 of adhesive material. First area 52 is positioned adjacent to portion 54 and second area 56 is located in portion 54. The positioning of second area 56 on portion 54 depends upon the number of times label 10 is wrapped around container 12.

Desirably, second area 56 is positioned on or near second end 50 of substrate 14.

As can be seen in FIGS. 4 and 5, in embodiment 40, substrate 14 may further include a security portion 58. Security portion 58 extends from at least a portion of the label 10 adjacent to the first area 52 and is adapted to be attached to a closure device, such as a lid, a cap or a top, for container 12. Security portion 58 is provided with an area 60 of adhesive material so that security portion 58 can be attached to the closure device of container 12. Security portion 58 is provided to indicate whether container 12 has been opened. When container 12 is opened, security portion 58 is torn. Desirably, security portion 58 will be torn is such a manner that it is either separated from the closure device or separated from substrate 14, indicating that container 12 has been opened. More desirably, a line of weakness 62 will be provided between first adhesive area 54 and security portion 58. By providing the line of weakness 62, security portion 58 will be more easily separated from substrate 14 and remain attached to the closure device of container 12 to indicate that container 12 has been opened. Desirably, the line of weakness 62 will be a score line, perforations, a partial tear, or other similar device to facilitate separation of security portion 58 from substrate 14. Most desirably, the line of weakness 62 will be perforations as shown in FIGS. 4 and 5.

As can also be seen in FIGS. 4 and 5, label 10 may optionally be provided with a line of weakness 74 which extends between the two edges of substrate 10 and parallel to first end 48 and second end 50. Line of weakness 74 can be provided so that second section 72, which includes portion 54 and second area 56, can be separated from first section 70, which includes first area 52. Desirably, the line of weakness 74 will be a score line, perforations, a partial tear, or other similar device to facilitate separation of second section 72 from first section 70. Most desirably, the line of weakness 74 will be perforations as shown in FIGS. 4 and 5.

As shown in FIG. 5, front surface 46 of substrate 14 includes a first message portion 62 and a second message portion 64. First message portion 62 is located on substrate 14 adjacent to second message portion 64. First message portion 62 and second message portion 64 are adapted to receive indicia, i.e., indicia can be printed on portions 62 and 64. Front surface 46 also includes an area 66 of release material 67. The exact positioning of area 66 on front surface 46 depends on the length of substrate 14 which extends around the circumference or perimeter of container 12. Desirably, area 66 will be positioned between first message portion 62 and second message portion 64, as shown in FIG. 5. However, area 66 could be positioned at either first end 48 or second end 50 such that only one message portion is provided.

Desirably, the label 10 also includes one or more spaces 68 free of release material 67 in the area 66. Spaces 68 are provided so that the strength of adhesion of second end 50 of substrate 14 to the front surface 46 of substrate 14 may be adjusted. The strength of adhesion of second area 56 of adhesive to area 66 of release material 67 can be adjusted by varying the area of coverage of release material 67 in area 66. For example, by reducing the area of coverage of release material 67 on area 66, second area 56 comes into contact with a portion of the front surface 46 which does not bear release material 67. This increases the strength with which second end 50 of substrate 14 adheres to front surface 46. As another example, the adhesion strength of second area 56 of adhesive to area 66 may be reduced by reducing the number of spaces 68 free of release material 67 in area 66. Enough release material 67 must be provided in area 66 so that second end 50 remains releasably secured to front surface 46. One skilled in the art will appreciate that the adhesion strength of second area 56 of adhesive to area 66 of release material 67 may also be altered by adjusting the amount of release material 67 applied to area 66. However, the preferred method of adjusting adhesion strength is by varying the area of coverage of release material 67 on area 66.

Figure 8:
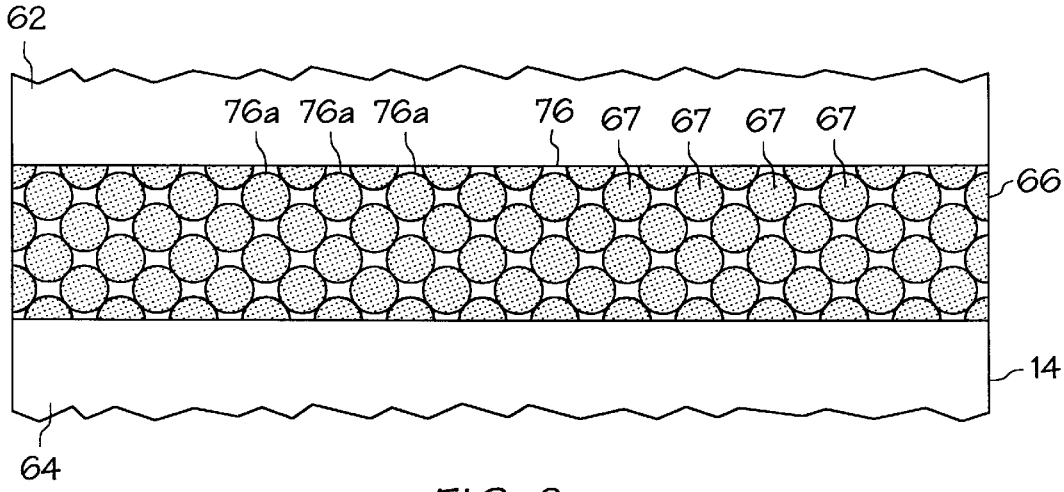
FIG. 8 presents a plan view of a representative pattern of release material on the area of release material.
Figure 9:
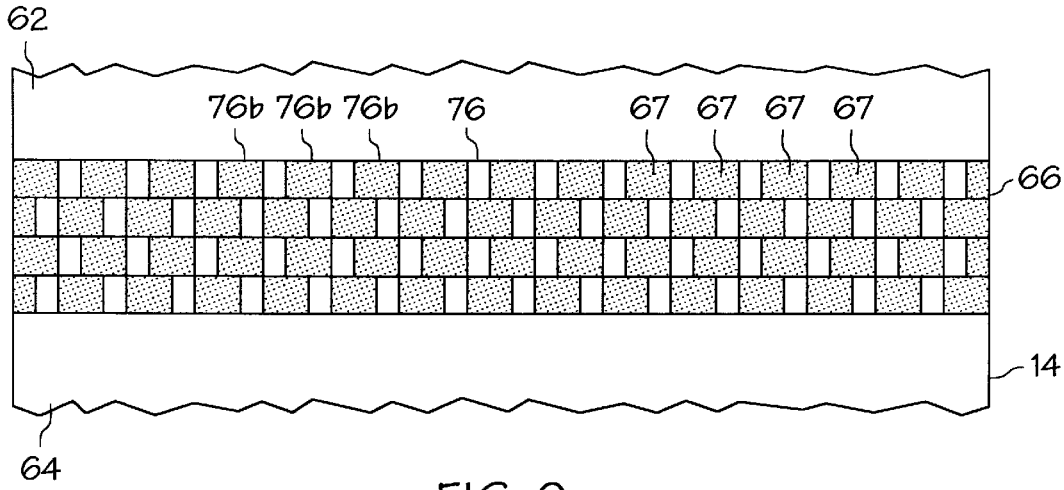
FIG. 9 presents a plan view of a representative pattern of release material on the area of release material.
Figure 10:
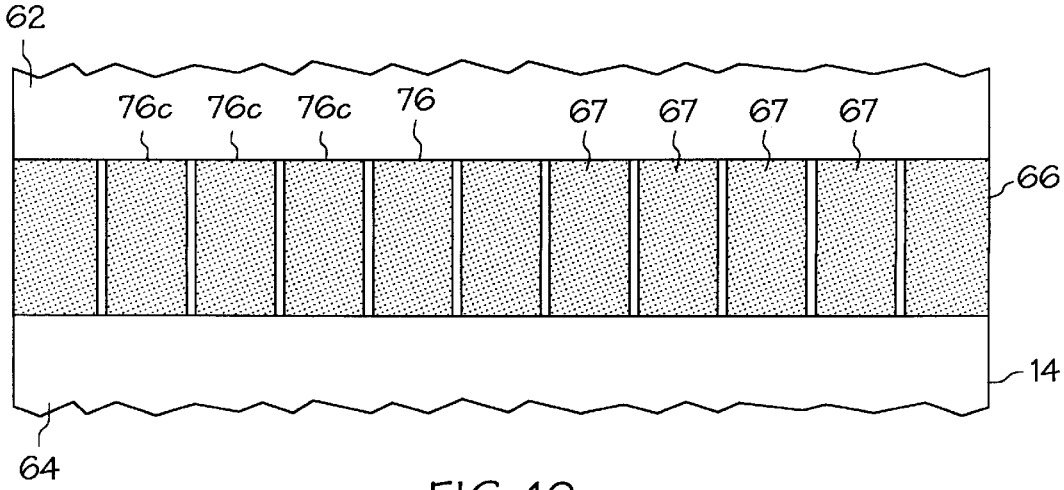
FIG. 10 presents a plan view of a representative pattern of release material on the area of release material.

More desirably, release material 67 is applied to the area 66 in a pattern 76 to create a plurality of spaces 68 free of release material. Exemplary patterns 76 are shown in FIGS. 8–10. As shown in FIG. 8, release material 67 can be applied to area 66 of substrate 14 in a pattern 76, such as series of circles or dots 76*a*. In the pattern 76 shown in FIG. 9, release material 67 is applied to area 66 of substrate 14 in a pattern 76, such as a series of parallelograms 76*b*. In the pattern shown in FIG. 10, the pattern 76 of release material 67 takes the form of a series of stripes 76*c*. One skilled in the art will appreciate that, to adjust the adhesion strength of second end 50 of substrate 14 to area 66, release material 67 can be applied in any type of pattern 76 to area 66 to provide spaces 68 free of release material on area 66.

Figure 6:
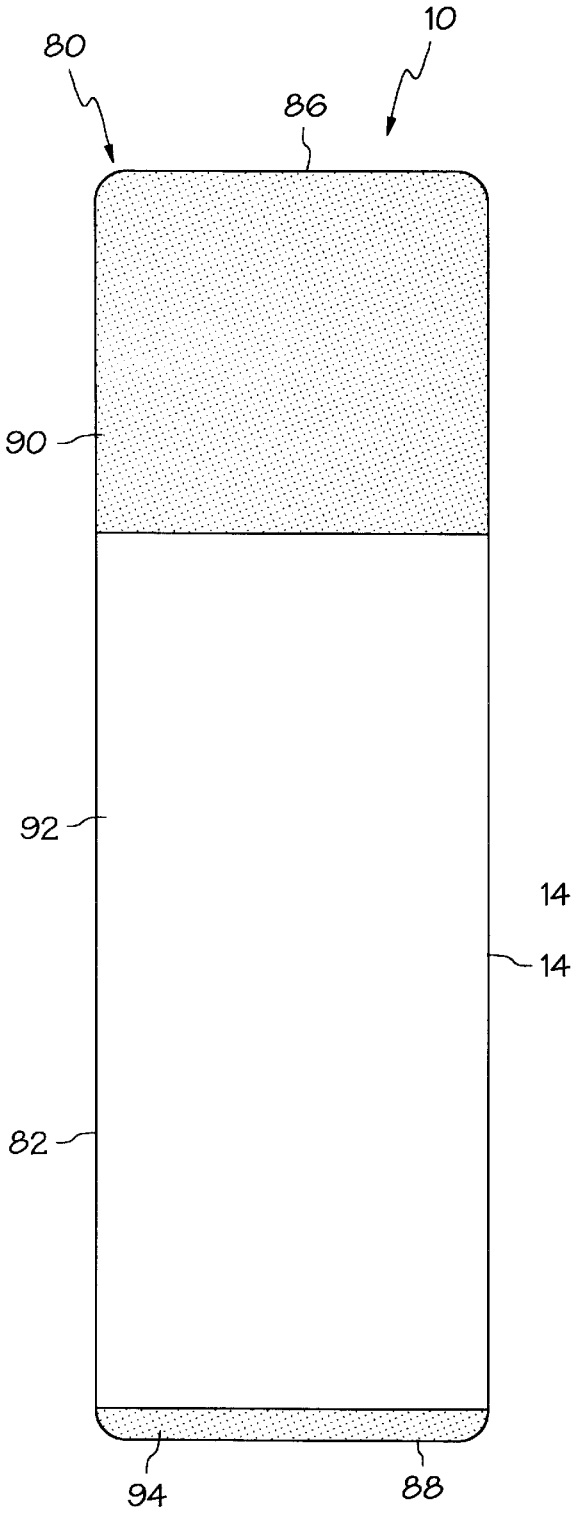
FIG. 6 presents a plan view of the back surface of an embodiment of this invention in which the label wraps around a container several times.
Figure 7:
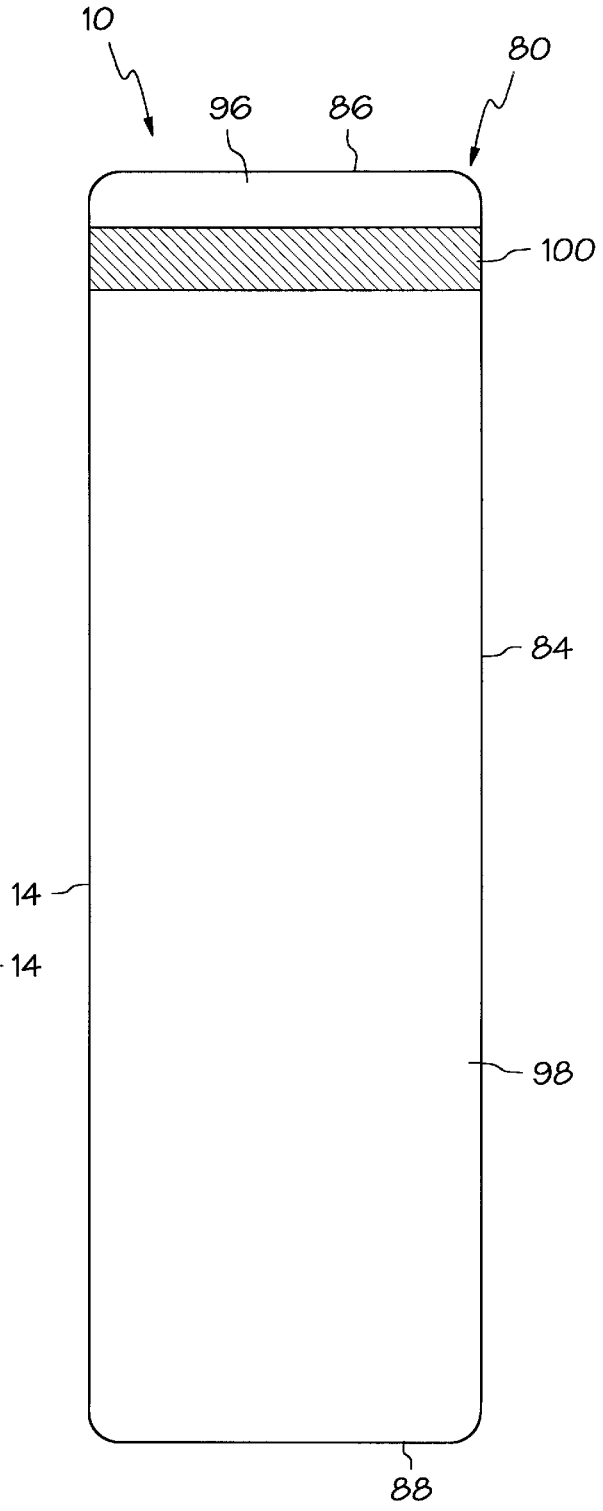
FIG. 7 presents a plan view of the front surface of an embodiment of this invention in which the label wraps around a container several times.

Another embodiment 80 of label 10 is shown in FIGS. 6 and 7. The embodiment 80 of label 10 also comprises a substrate 14 which includes a first, back surface 82, shown in detail in FIG. 6, and a second, front surface 84, shown in detail in FIG. 7. Substrate 14 has a first end 86, which is designed to be attached to container 12, and a second end 88, which is releasably secured to the front surface 84 of substrate 14. Second end 88 can be repeatedly removed from and reattached to the front surface 84 of substrate 14 without limiting the effectiveness of label 10.

As shown in FIG. 6, back surface 82 includes a first area 90 of adhesive material, a portion 92 free of adhesive and a second area 94 of adhesive material. First area 90 is positioned adjacent to portion 92 and second area 94 is located in portion 92 near second end 88 of substrate 14.

As shown in FIG. 7, front surface 84 of substrate 14 includes a first message portion 96 and a second message portion 98. First message portion 96 is located on substrate 14 adjacent to second message portion 98. First message portion 96 and second message portion 98 are adapted to receive indicia, i.e., indicia can be printed on portions 96 and 98. Front surface 84 also includes an area 100 of release material. The exact positioning of area 100 on front surface 84 depends on the length of substrate 14 which extends around the circumference or perimeter of container 12. Desirably, area 100 will be positioned between first message portion 96 and second message portion 98, as shown in FIG. 7. However, area 100 could be positioned at or near either first end 86 or second end 88 such that only one message portion is provided.

The embodiment 80 shown in FIGS. 6 and 7 is designed to be wrapped around the surface 12*a* of container 12 several times. As can be seen in embodiment 80, the portion 92 free of adhesive material on back surface 82 of substrate 14 has a length several times longer than the first area 90 of adhesive material. Typically, area 90 will have a length equal to or less than the circumference, or perimeter, of container 12 and portion 92 will have a length several times longer than that of area 90. Further, in embodiment 80, the second area 94 of adhesive material is positioned on second end 88 of substrate 14 to provide portion 92 with a maximum area.

Substrate 14 is chosen from materials known to those skilled in the art for serving as a substrate for adhesive materials and release materials, as well as a printing surface. Materials commonly used include, but are not limited to, glossy paper, dull paper, Kraft paper, synthetic paper, latex impregnated papers, foils, and films, including polymeric films.

The adhesive materials used on the first areas 24, 52 and 90 of adhesive material may be pressure sensitive adhesives or other conventional adhesives which are used to secure two materials. Such adhesives include, but are not limited to, epoxy, polyurethane, neoprene, nitrile and silicone-type adhesives. The adhesive used on second areas 28, 56 and 94 of adhesive material and adhesive strips 30 is a pressure sensitive adhesive. Useful pressure sensitive adhesives include acrylic based, rubber based, silicone based, UV curable, and the like. All adhesives may be applied by conventional methods which can achieve pattern or stripe coatings, such as extruding, slot coating, reverse roll coating, flexography, reverse roll, direct gravure, and the like.

The release material used on any portion of label 10 which contains a release material may be any conventional material suitable for that purpose known to those of skill in the art such as silicone-based materials including UV cured release materials. Release materials may be applied in-line or off-line using conventional printing methods including flexography, letterpress, lithography or gravure. Curing methods of the release coating include heating, air drying, or UV drying, depending upon the printing method employed. The preferred method for attaining a release coating is by flexography using an UV curable release material.

Although container 12 has been depicted in the FIG. 1 as being cylindrical, one skilled in the art will appreciate that the label 10 of this invention will work equally well with both round and non-round containers, such as, for example, squareshaped containers, rectangularly-shaped containers, and octagonally-shaped containers.

While certain representative embodiments and details have been shown for the purpose of illustrating the invention, it will be apparent to those skilled in the art that various changes, modifications and alterations can be made to the product described herein without departing from the scope of the invention, which is defined in the appended claims.

What is claimed is:

1. An over-wrap label for a container comprising:

a label substrate having a first end, a second end, a first major surface and a second major surface;

said first major surface including a first area of adhesive material adapted to secure said first end of said label substrate to a container and a second area of adhesive material adjacent to said second end of said label substrate, at least one portion of said first major surface remaining free of adhesive; and said second major surface including an area of release material, said label substrate being of a size such that said second end of said label substrate is adapted to extend around a container and overlap said first end, said second end being releasably securable to said second major surface of said label substrate by contacting said second area of adhesive material with said area of release material;

said label further including at least one additional area of adhesive material and at least one additional area of release coated material so that a portion of said substrate in addition to said second end of said substrate can be releasably secured to said second major surface.

2. An over-wrap label for a container comprising:

a label substrate having a first end, a second end, a first major surface and a second major surface;

said first major surface including a first area of adhesive material adapted to secure said first end of said label substrate to said container and a second area of adhesive material adjacent to said second end of said label substrate, at least one portion of said first major surface remaining free of adhesive, said first major surface also including at least one strip of adhesive extending between said first area of adhesive material and said second area of adhesive material; and said second major surface including an area of release material, said label substrate being of a size such that said second end of said label substrate is adapted to extend around a container and overlaps said first end, said second end being releasably securable to said second major surface of said label substrate by contacting said second area of adhesive material with said area of release material and said second major surface also including at least one strip of release material, said strip of adhesive material on said first major surface contacting said strip of release material on said second major surface to further releasably secure said second end of said substrate to said second major surface.

3. An over-wrap label for a container comprising:

a label substrate having a first end, a second end, a first major surface and a second major surface;

said first major surface including a first area of adhesive material adapted to secure said first end of said label substrate to said container and a second area of adhesive material adjacent to said second end of said label substrate, at least one portion of said first major surface remaining free of adhesive;

said second major surface including an area of release material, said label substrate being of a size such that said second end of said label substrate is adapted to extend around a container and overlap said first end, said second end being releasably securable to said second major surface of said label substrate by contacting said second area of adhesive material with said area of release material; and said area of release material including at least one space which is free of release material, said space adapted to provide for more secure bonding of said second end of said substrate to said second major surface while still allowing said second end of said substrate to be releasably securable to said second major surface.

4. The label of claim 3 further including on said second major surface at least one message portion.

5. The label of claim 3 wherein said portion free of adhesive on said first major surface is adapted to receive indicia.

6. The label of claim 3 wherein said first area of adhesive has a length adapted to equal about the circumference of a container.

7. The label of claim 3 wherein said portion of said first major surface which is free of adhesive is adapted to extend around a container at least one time.

8. The label of claim 3 wherein said portion of said first major surface which is free of adhesive is adapted to extend around a container more than one time.

9. The label of claim 3 further including a security portion extending from an edge of said label substrate bearing said first area of adhesive material, said security portion bearing an adhesive which is adapted to be attached to a closure device for said container such that said container cannot be opened without tearing said security portion.

10. The label of claim 9 further including a line of weakness between said first area of adhesive material and said security portion so that said security portion will separate from said label substrate when said container is opened.

11. The label of claim 10 wherein said line of weakness is selected from the group consisting of a score line, perforations, and a partial tear.

12. The label of claim 11 wherein said line of weakness is perforations.

13. The label of claim 3 further including a line of perforations between said first area of adhesive material and said portion free of adhesive material to facilitate separation of said portion free of adhesive material from said first area of adhesive material.

14. The label of claim 13 wherein said line of weakness is selected from the group consisting of a score line, perforations, and a partial tear.

15. The label of claim 14 wherein said line of weakness is perforations.

16. The label of claim 3 wherein said area of release material includes a plurality of said spaces free of release material.

17. The label of claim 16 wherein said release material is applied to said area of release material in a pattern to create said plurality of spaces free of release material.

* * * * *